United States Patent [19]

Matsuzaki et al.

[11] Patent Number: 4,761,649

[45] Date of Patent: Aug. 2, 1988

[54] CABLE DETECTOR

[75] Inventors: Akira Matsuzaki, Tokyo; Shigeki Taniguchi, Chiba, both of Japan

[73] Assignee: Kokusai Denshin Denwa Co., Ltd., Tokyo, Japan

[21] Appl. No.: 49,367

[22] Filed: May 14, 1987

[30] Foreign Application Priority Data

May 16, 1986 [JP] Japan ..... 61-110474

[51] Int. Cl.[4] ..... H04B 13/02

[52] U.S. Cl. ..... 340/850; 294/66.1; 200/61.44; 114/221 A

[58] Field of Search ..... 340/850; 324/326; 114/221 A; 294/66.1, 66.2; 200/61.42, 61.44; 43/42.7

[56] References Cited

U.S. PATENT DOCUMENTS

| | | | |
|---|---|---|---|
| 2,910,034 | 10/1959 | Sullivan | 114/221 A |
| 3,319,426 | 5/1967 | Slonczewski | 294/66.1 |
| 3,516,158 | 6/1970 | Ferrentino | 294/66.1 |
| 4,283,681 | 8/1981 | Kazuomi et al. | 340/850 |

*Primary Examiner*—Charles T. Jordan
*Assistant Examiner*—John W. Eldred
*Attorney, Agent, or Firm*—Armstrong, Nikaido, Marmelstein & Kubovcik

[57] ABSTRACT

A cable detector has a plurality of rotatably series connected hooks having an opening mouth for accepting a cable on sea bottom with an equal angular intervals, a contact pressure sensing means for indicating that a cable is engaged with one of said hooks by measuring contact pressure on one of the hooks, and an electrical switch which is actuated by said contact pressure sensing means to provide an electrical signal when a cable is detected.

5 Claims, 3 Drawing Sheets

CABLE DETECTOR

BACKGROUND OF THE INVENTION

The present invention relates to a cable detector which searches a communication cable and/or a power cable installed under water, in particular, it relates to structure of a cable sensor mounted on a cable detector.

When there is something wrong with a cable under water, the damaged portion of the cable is lifted on to a boat and repaired.

The conventional cable detector is anchor type as shown in the Japanese patent laid open publication No. 26017/80.

FIGS. 5 and 6 show that conventional cable detector. In FIG. 5, the cable detector has a cylindrical main body 60 which has radially extended legs 61 at one end of the main body. The main body 60 has a rope connector 62 at which a rope for pulling the cable detector is fixed. The main body 60 has hollow room, where a water tight switch 63 which indicates the presence of a cable is mounted. At one end of each leg 61, is provided a bearing 64 which supports a movable slide rod 65. Each slide rod 65 has a cable sensor 66 on one end, and the other end of the rod 65 is fixed to the common support 67, which has a slidable rod 69 at the center of the same. The nut 68 fixes the rod 69 to the common support 67. The rod 69 has a spring stopper 70 at the other end. A coil spring 71 is provided around the rod 69. One end of the coil spring 71 is fixed to the stopper 70, and the other end of the spring 71 touches with the end of the main body 60.

When the cable detector of FIGS. 5 and 6 is pulled by a boat so that the cable detector runs perpendicular to the cable to be detected, one of the legs 61 is engaged with the cable 72. Then, the cable sensor 66 at one end of the leg is pushed by the cable, and shifts in the opposite direction of the moving direction of the cable detector. Therefore, the slide rod 65 slides, and the common support 67 and the slide rod 69 shift. The shift of the rod 69 pushes the coil spring 71, and actuates the switch 63, which transmits the sense signal to the boat through a signal transmission cable (not shown). Thus, the boat can detect the presence of a cable through the electrical signal by the switch 63.

However, the conventional cable detector described above has the disadvantages as follows.

When the radially extended legs 61 engage rocks on the sea bed, the cable detector operates incorrectly, and indicates as if there was a cable. Further, when the shape of the sea bed is irregular, the legs can not follow the profile of the sea bed, and miss cables.

Therefore, the conventional cable detector is not reliable, and takes long time to search for a cable.

SUMMARY OF THE INVENTION

It is an object, therefore, of the present invention to overcome the disadvantages and limitations of a prior cable detector by providing a new and improved cable detector.

It is also an object of the present invention to provide a cable detector which is reliable in operation, and operates correctly even when a cable is installed on a rocky or irregular sea bed.

The above and other objects are attained by a cable detector having a plurality of hook members bendably coupled in series with one another so that an opening entrance of each hook member has a predetermined angular interval; each hook member having a contact pressure sensing means which is actuated by being pushed by a cable when the hook member is engaged with a cable; a switch means provided in the cable detector so that said switch means is activated by output of said contact pressure sensing means; and means for transferring status of said switch means to a boat.

BRIEF DESCRIPTION OF THE DRAWINGS

The foregoing and other objects, features, and attendant advantages of the present invention will be understood by means of the following description and accompanying drawings wherein.

DESCRIPTION OF THE PREFERRED EMBODIMENTS

Figure 1:
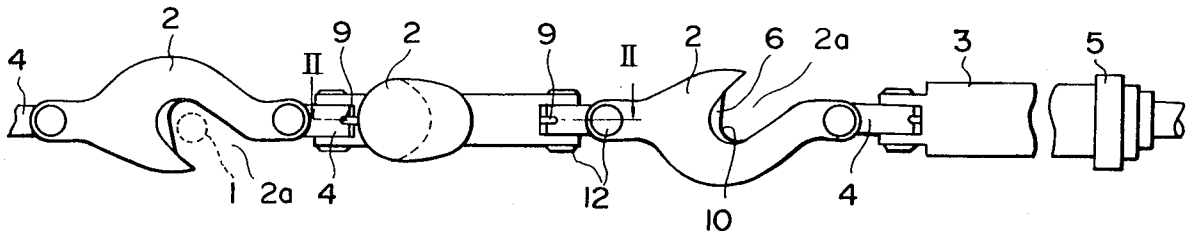
FIG. 1 is a plane view of the cable detector according to the present invention.

FIG. 1 is a plane view of the cable detector according to the present invention. In the figure, the present cable detector has a plurality of C-ring shaped cable hooks 2 each of which has a gap or an opening entrance 2*a* for accepting a cable, the cylindrical main body 3 which includes a water-tight switch. The hooks 2 are coupled with one another in a series through a hook connector 4 in the pulling direction of the cable detector as shown in the figure. The hooks are coupled in a series so that the opening entrance 2*a* of each hook has the angular interval of 90° to each neighboring hook. The number of hooks is not restricted to 4, but any number of hooks is possible. When N number of hooks is used, the angular interval of the direction of the opening entrance of each hook is 360/N degrees. The extreme end hook is rotatably coupled with the main body 3 through the connector 4, and the pin 12. The other end of the main body 3 has a rope connector 5 to which a rope (not shown) is coupled so that the cable detector is pulled by a boat on the sea via the rope.

When a cable is engaged with a hook 2, this is detected by a contact pressure sensing means, which actuates an electrical switch means. The contact pressure sensing means senses the contact pressure on the inside surface of the neck of the hook 2 by the cable 1. The contact pressure sensing means has a slide hook 6 mounted in a hook 2, a wire rope 9 which couples the slide hooks 6, and some spring means for initially positioning said slide hook.

Figure 2:
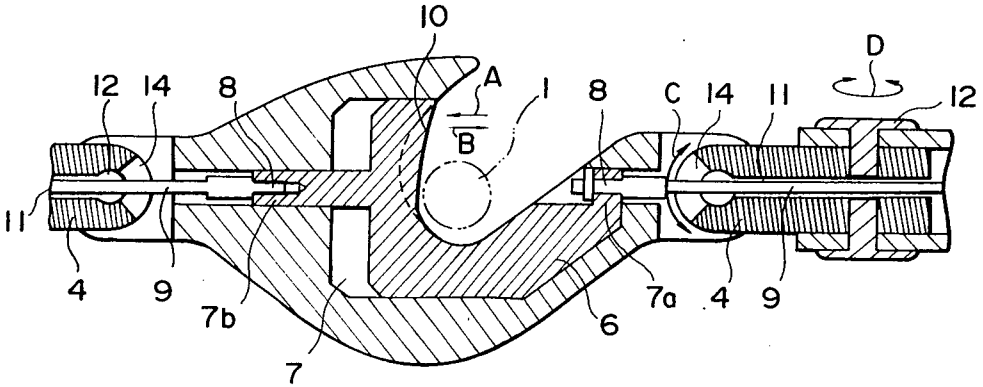
FIG. 2 is a cross sectional view along the line II—II of FIG. 1.

FIG. 2 is a cross section along the line II—II of FIG. 1.

The hook 2 has a slide hook 6 which is slidable along the inside wall of the hook 2. The hook 2 has a guide 7 along with the slide hook 6 moves in the axis direction of the main body 3 (direction A and/or direction B). The slide hook 6 is in the shape of a plate, and has projections 7*a* and 7*b* at both extreme ends of the same. Those projections 7*a* and 7*b* engage with wire rope 9 in the elongated hole 8 provided in the hook 2. The wire rope 9 functions to couple a plurality of hooks together.

In the above structure, when one of the slide hooks slides in the direction A upon detection of a cable, the adjacent slide hook in the adjacent hook slides also in the direction A, since the adjacent hook is coupled with the first slide hook through the wire rope 9. Thus, the wire rope 9 functions to transfer the slide movement of one of the slide hooks to the other slide hooks. The slide hook on the extreme end is coupled with a bar which is engaged with a water tight switch through the wire rope 9.

When the cable detector does not detect a cable, the slide hook 6 is positioned at the position of FIG. 2 where the cable contact surface 10 of the slide hook can slide in the direction A.

Figure 3:
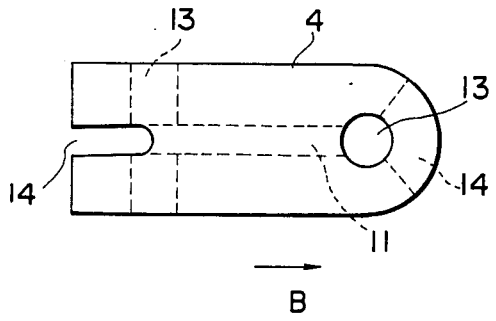
FIG. 3 shows structure of a hook connector.

FIG. 3 shows a plane view of a hook connector 4 which is shown in FIGS. 2 and 3. The connector 4 functions to couple the hooks 2 in series so that each hook can rotate around the axis of the hook. The connector 4 has a pair of perpendicularly spaced holes 13 which engage with a pin 12 so that the hook 2 can rotate in the direction C or D, or a hook can bend. The connector 4 has also an opening 14 at one end of the same. Between the hole 13 and the opening 14, a through hole 11 is provided along the center axis of the connector 4 so that a wire rope 9 which is connected to the hole 8 of the slide hook 6, is inserted in the hole 11. The pin 12 has also a hole through which the wire rope 9 passes.

The direction of the axis of the hole 13 of each hook is determined so that said direction differs by 90° from one another, therefore, the opening entrance of each hook has the angular interval by 90°.

The opening 14 is tapered in the directions C and D (see FIG. 2), so that when the hook 2 rotates in the direction C or D, the wire rope 9 which runs in the hole 11 does not suffer from the excess load, and/or the sharp bent.

Figure 4:
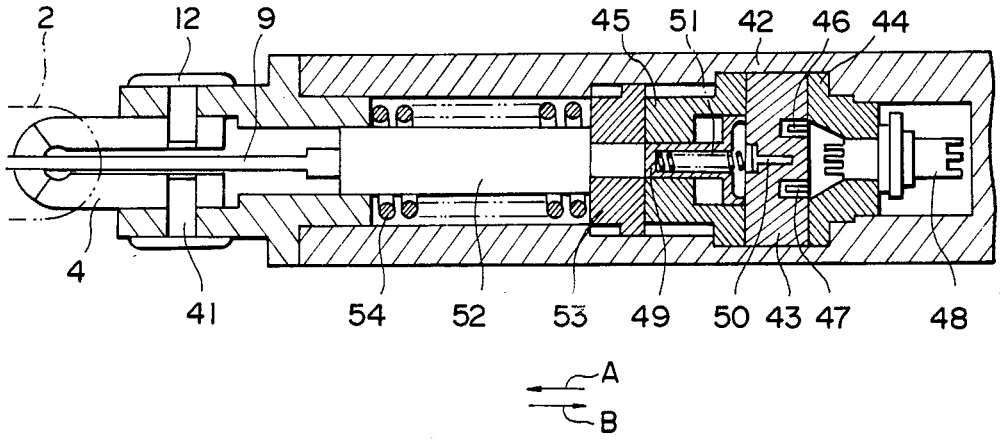
FIG. 4 is a cross sectional view of a hollow cylindrical main body.
Figure 5:
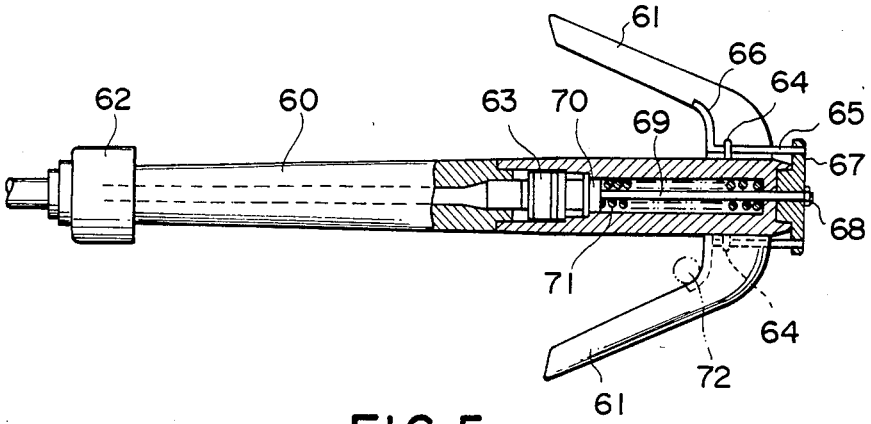
FIG. 5 PRIOR ART
FIG. 5 is a plane view of a prior cable detector with a portion fragmented.
Figure 6:
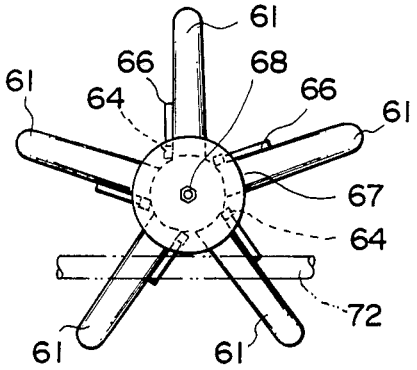
FIG. 6 PRIOR ART
FIG. 6 is a side view of FIG. 5.

FIG. 4 shows the cross section of the cylindrical main body 3, which has a hole 41 for rotatably supporting a hook 2, at the end of the main body 3. The main body 3 has a water tight switch 42 in the body 3. The water tight switch 42 has a switch 43 and the covers 44 and 45, to which the switch 43 is fixed through water tight seal (not shown) by bolts (not shown). The switch 43 has a lead switch 46, and a permanent magnet 47, and the cover 44 has an electrical connector 48 which is electrically coupled with said switch 43. A slide member 49 is provided in the cover 45 so that it can slide in the direction A (or B) so that said slide member 49 actuates the switch 43. The slide member 49 has ferro-magnetic chip 50 at the extreme end of the slide member 49. A spring 51 is coupled with the slide member 49 so that the slide member 49 is initially pushed in the direction A.

The slide bar 52 can slide along the axis of the main body in the direction A and B. One end of the slide bar 52 is engaged with a wire rope 9 which is connected to the slide hook 6, and the other end of the slide bar 52 is coupled with the stopper 53. A spring 54 is provided around the slide bar 52 so that one end of the spring 54 touches with the stopper 53 and the other end touches with the main body itself. Therefore, when the stopper 53 shifts in the direction A (or the slide bar 52 shifts in the direction A against the spring 54), the slide member 49 slides in the direction A by the action of the spring 51. When the present cable detector does not detect a cable, the wire rope 9 is pulled in the direction A by the spring 54, therefore, the cable contact 10 of the slide hook 6 of the hook 9 projects in the direction B.

In operation, the present cable detector is pulled on a sea bottom so that it runs approximately perpendicular to a cable which is subject to search. As the hooks 2 connected in series with one another are rotatable in the direction C and D (FIG. 2) or bendable, the hooks can follow the complicated contour of a sea bottom.

It is now assumed that the third hook 2 from the main body 3 is engaged with a cable 1, the slide hook 6 which is pulled by the wire rope 9 in the direction B but is stopped by the cable 1, slides in the direction A which is opposite to the pulling direction. Then, the slide bar 52 shifts in the direction A so that the spring 54 is pushed, through the wire rope 9. Then, the slide member 49 slides in the direction A pushing the spring 51, and also the ferro-magnetic chip 50 located initially between the lead switch 46 and the permanent magnet 47 shifts. Then, the magnetic flux by the permanent magnet 47 applied to the lead switch 46 is changed by the shift of said ferro-magnetic chip 50. Then, the water tight switch 42 is activated. The electrical signal of the water tight switch 42 is transferred to a signal receiver on a boat through a signal transmission line (not shown). Thus, the cable detection is recognized on a boat correctly.

It should be appreciated that even when the hook 2 rotates in the directions C and D, and is engaged with a cable which is subject to search, the shift of the slide hook 6 is transferred to the wire rope 9 through the tapered opening 14 at the end of the connector 4, and the cable is also detected.

It should be appreciated that some modifications are possible to those skilled in the art. For instance, the angular interval of the opening entrance of the hooks is not restricted to 90°, but that angular interval is 360/N, where N is the number of hooks.

Further, the shape of the opening 14 at the end of the connector 4 is not restricted to tapered shape, but circular opening or other shape of opening is of course possible.

The present cable detector is advantageous in searching a cable when a sea bottom is hard (like rock), and/or complicated and irregular in contour.

Further, the present cable detector has the advantage that it does not send wrong detection signals when the hook is engaged with a projection of a rock on a sea bottom.

Therefore, the search time for detecting a cable is saved considerably by using the present cable detector, and the operation efficiency of the cable detection is improved.

From the foregoing, it will now be apparent that a new and improved cable detector has been found. It should be understood of course that the embodiments disclosed are merely illustrative and are not intended to limit the scope of the invention. Reference should be made to the appended claims, therefore, rather than the specification as indicating the scope of the invention.

What is claimed is:

1. A cable detector for detecting a cable under water comprising a contact pressure sensing member, a switch member activated by output of said contact pressure sensing member, a plurality of hook members connected in series and a plurality of connectors each connecting adjacent two hook members by pin joints, each of said hook members having a slidable slide hook within an open entrance therein for receiving the cable, each of said connectors being provided with a through hole and further provided with a tapered opening at both ends thereof, and a wire rope connecting adjacent two slide hooks passing through said holes, and said wire rope being further connected to said contact pressure sensing member.

2. A cable detector according to claim 1, wherein the number of said hook members is at least four.

3. A cable detector according to claim 1, wherein adjacent open entrances are rotated 90° from one another with adjacent open entrances are rotated 90° from one another with respect to the axis of said cable detector.

4. A cable detector according to claim 1, wherein adjacent open entrances are rotated 360/N degrees when the number of hook members is N.

5. A cable detector according to claim 1, wherein said switch means has a lead switch, a permanent magnet for actuating said lead switch, and a ferro-magnetic chip for selectively actuating said lead switch responsive to shift of the chip.

* * * * *